US005897113A

United States Patent [19]

Kondo et al.

[11] Patent Number: 5,897,113

[45] Date of Patent: Apr. 27, 1999

[54] DOCUMENT FEEDER WITH RESPONSIVE PAPER RECEIVING TRAY

[75] Inventors: Kazuhisa Kondo; Jyun Kusakabe, both of Osaka, Japan

[73] Assignee: Mita Industrial Co., Ltd., Osaka, Japan

[21] Appl. No.: 08/727,784

[22] Filed: Oct. 8, 1996

[30] Foreign Application Priority Data

Oct. 20, 1995 [JP] Japan ..... 7-273251

[51] Int. Cl.[6] ..... B65H 31/20

[52] U.S. Cl. ..... 271/213; 271/223; 271/207

[58] Field of Search ..... 271/223, 213, 271/207

[56] References Cited

U.S. PATENT DOCUMENTS

| | | | |
|---|---|---|---|
| 5,234,212 | 8/1993 | Dutra, Jr. | 271/213 |
| 5,464,205 | 11/1995 | Bang | 271/213 |

FOREIGN PATENT DOCUMENTS

| | | | |
|---|---|---|---|
| 61-169446 | 7/1986 | Japan | 271/213 |
| 4-39259 | 2/1992 | Japan | 271/223 |
| 4-243766 | 8/1992 | Japan | 271/213 |
| 5-132215 | 5/1993 | Japan | 271/213 |
| 58-139961 | 8/1993 | Japan | 271/223 |
| 6-234451 | 8/1994 | Japan | 271/213 |

*Primary Examiner*—William E. Terrell
*Assistant Examiner*—Patrick Mackey
*Attorney, Agent, or Firm*—Beveridge, DeGrandi, Weilacher & Young, LLP

[57] ABSTRACT

An automatic document feeder according to the present invention is mountable on a copying machine. The automatic document feeder mounted on the copying machine is displaceable to a closed state and an open state with respect to the copying machine. In the closed state, originals can be automatically set on the copying machine by the automatic document feeder. When the originals are manually set on the copying machine, the automatic document feeder is brought into the open state. A tray 11 provided in the automatic document feeder is divided into a main tray 61 and a sub tray 62. The main tray 61 and the sub tray 62 are so connected to each other that their connected state is changeable to an extending state or a contracted state. When the automatic document feeder is brought into the open state, the connected state between the main tray 61 and the sub tray 62 is automatically brought into the contracted state.

5 Claims, 12 Drawing Sheets

DOCUMENT FEEDER WITH RESPONSIVE PAPER RECEIVING TRAY

BACKGROUND OF THE INVENTION

1. Field of the Invention

The present invention relates to an automatic paper feeder which can be mounted on an image processing apparatus such as a copying machine, a facsimile, or an original image reader. More particularly, the present invention relates to an automatic document feeder for automatically conveying originals to be read by an image processing apparatus.

2. Description of the Prior Art

A copying machine is taken as an example. An automatic document feeder mounted on the main body of the copying machine has been conventionally known. There exist automatic document feeders of various types and in various shapes. When the automatic document feeder is arranged on the main body of the copying machine, the automatic document feeder has been recently designed so that the width and the depth thereof fall in the ranges of the width and the depth of the main body of the copying machine, that is, it is not projected rightward and leftward or backward or forward from the main body of the copying machine.

FIG. 12 is a schematic diagram showing one example of a conventional automatic document feeder for a copying machine, which is viewed from the front. An automatic document feeder 92 mounted on the upper surface of the main body 91 of the copying machine is caused to have such a shape that the width and the depth thereof fall in the width and the depth of the main body 91 of the copying machine. Therefore, the upper surface in the center of the automatic document feeder 92 is taken as an original set surface 93. Originals set on the original set surface 93 are taken in from an inlet port 94 on the left side, are rotated in the reverse direction through an angle of 180°, and are sent onto an original glass plate 95 provided on the upper surface of the main body 91 of the copying machine. The contents of the originals are read in this state, and copies of the originals are made in the main body 91 of the copying machine. Thereafter, the originals on the original glass plate 95 are moved rightward, are rotated in the reverse direction through an angle of 180°, and are discharged onto a tray 97 from a discharge port 96 on the right side. The tray 97 extends obliquely up to a space above the original set surface 93 with its lower end mounted in the vicinity of a left end of the original set surface 93. By thus arranging the tray 97, the space above the original set surface 93 is effectively utilized, and the tray 97 is not projected outward from the main body 91 of the copying machine.

When an attempt to set originals of large size, for example, A3 size in Japanese Industrial Standard (JIS) (hereinafter referred to as "JIS A3 size") on the original set surface 93 is made, the tray 97 extending to the space above the original set surface 93 interferes with the setting.

In such a case, the originals have been set on the original set surface 93 after the tray 97 is manually raised almost perpendicularly, as indicated by a broken line, so as not to interfere with the setting in the conventional automatic document feeder. Further, the tray 97 is returned to the original oblique state after the originals are set.

The automatic document feeder 92 is mounted on the upper surface of the main body 91 of the copying machine and its front side can be opened upward with its opposite side as a fulcrum, therefore, the originals can be manually set on the original glass plate 95.

In a case where the originals are manually set on the original glass plate 95 in a state where the tray 97 in the automatic document feeder 92 is almost perpendicularly raised, when the automatic document feeder 92 is opened upward in this state, the tray 97 is projected toward a space behind the main body 91 of the copying machine. When there is a wall or the like in the space behind the main body 91 of the copying machine, therefore, the tray 97 collides with the wall.

SUMMARY OF THE INVENTION

An object of the present invention is to provide, in an automatic paper feeding comprising a tray for receiving discharged paper sheets, an automatic paper feeder capable of preventing the tray from being widely projected from the automatic paper feeder even when the paper sheets are manually arranged.

The automatic paper feeder according to the present invention comprises a tray for receiving paper sheets. The tray has a main tray and a sub tray. The main tray and the sub tray are so connected to each other by connecting means that their connected state can be changed. The connecting means can change the connected state to an extending state where the main tray extends from the sub tray and a contracted state where the sub tray is folded or superimposed with respect to the main tray. The change of the connected state by the connecting means allows the external shape of the entire tray to be increased or decreased. Accordingly, the amount of projection of the tray is increased or decreased. If the connected state is changed to the extending state by the connecting means, the tray is increased in size, whereby the tray can stably receive large paper sheets. On the other hand, if the connected state is changed to the contracted state by the connecting means, the amount of projection of the tray is decreased. In cases such as a case where the paper sheets are manually set, when the automatic paper feeder is brought into an open state with respect to an image forming apparatus, the tray can be prevented from colliding with a surrounding wall or the like.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An automatic document feeder for a copying machine will be described in detail by way of example as one embodiment of the present invention. The automatic paper feeder according to the present invention is not limited to the automatic document feeder for a copying machine, and is also applicable to an automatic document feeder for a facsimile, an automatic document feeder for a document reader connected to a computer or the like, an automatic paper feeder for a printer, and the like.

Figure 1:
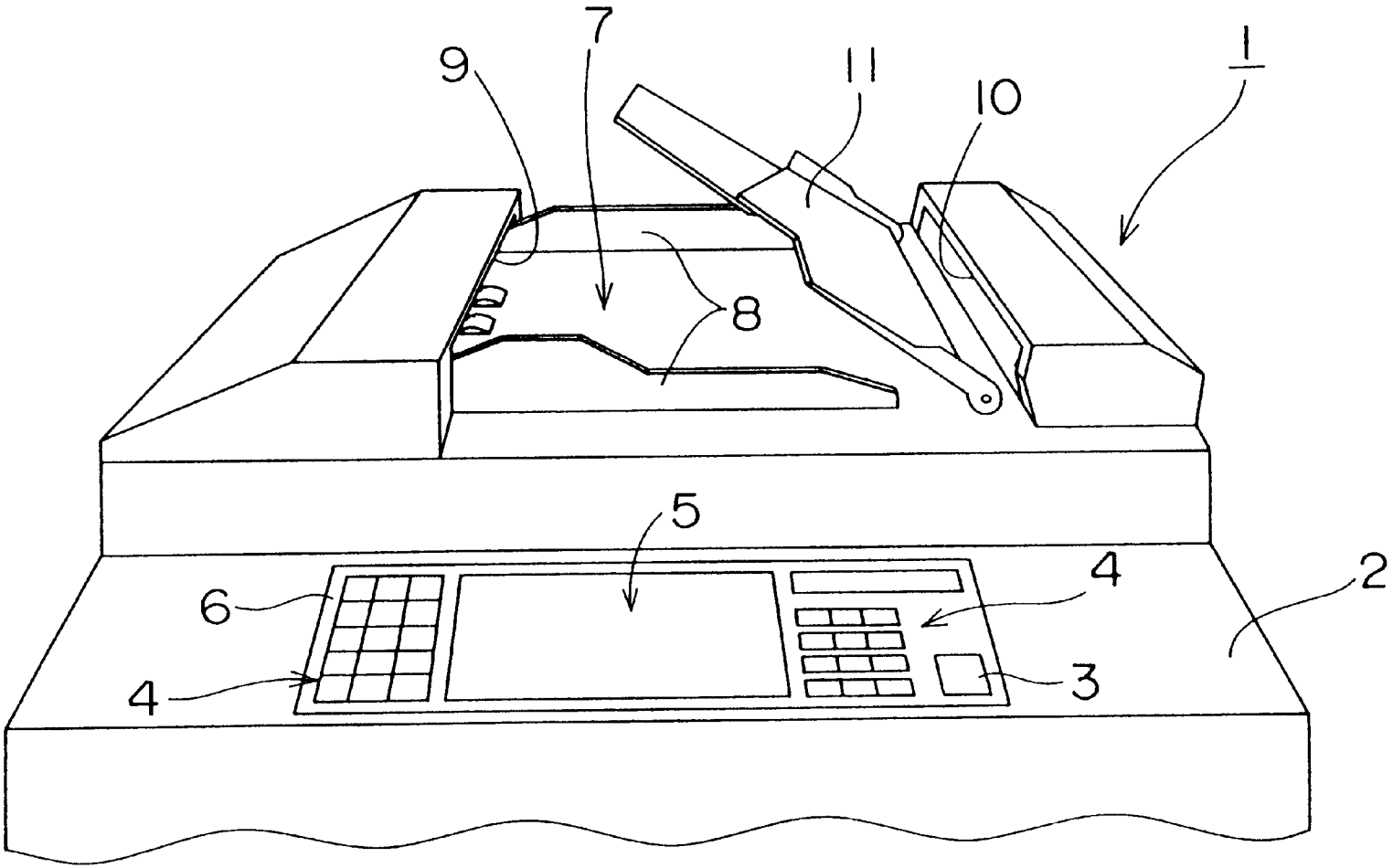
FIG. 1 is a perspective view showing the external construction of an automatic paper feeder according to an embodiment of the present invention in a case where it is used as an automatic document feeder for a copying machine.
Figure 2:
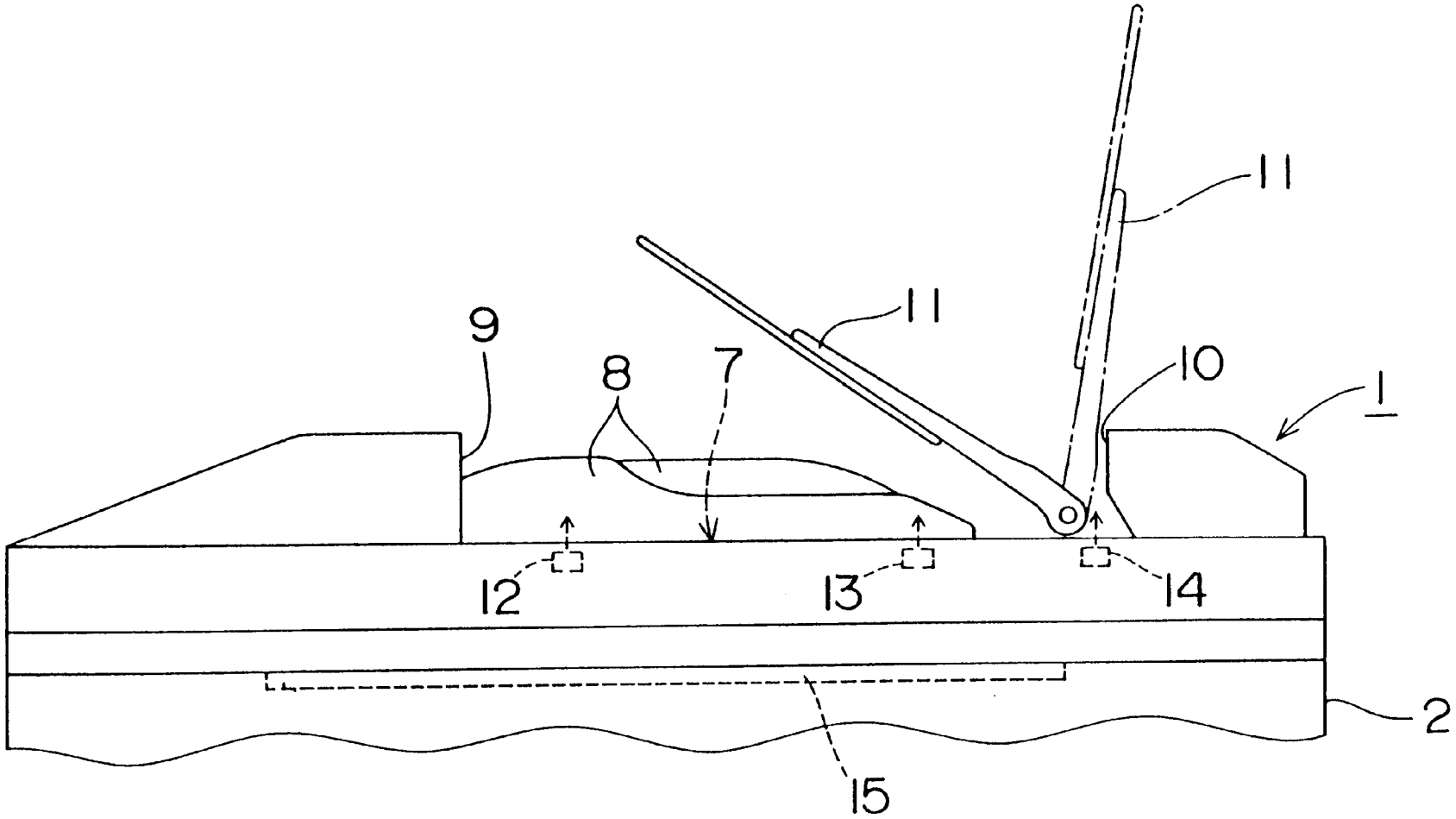
FIG. 2 is a front view of the automatic document feeder shown in FIG. 1.
Figure 3:
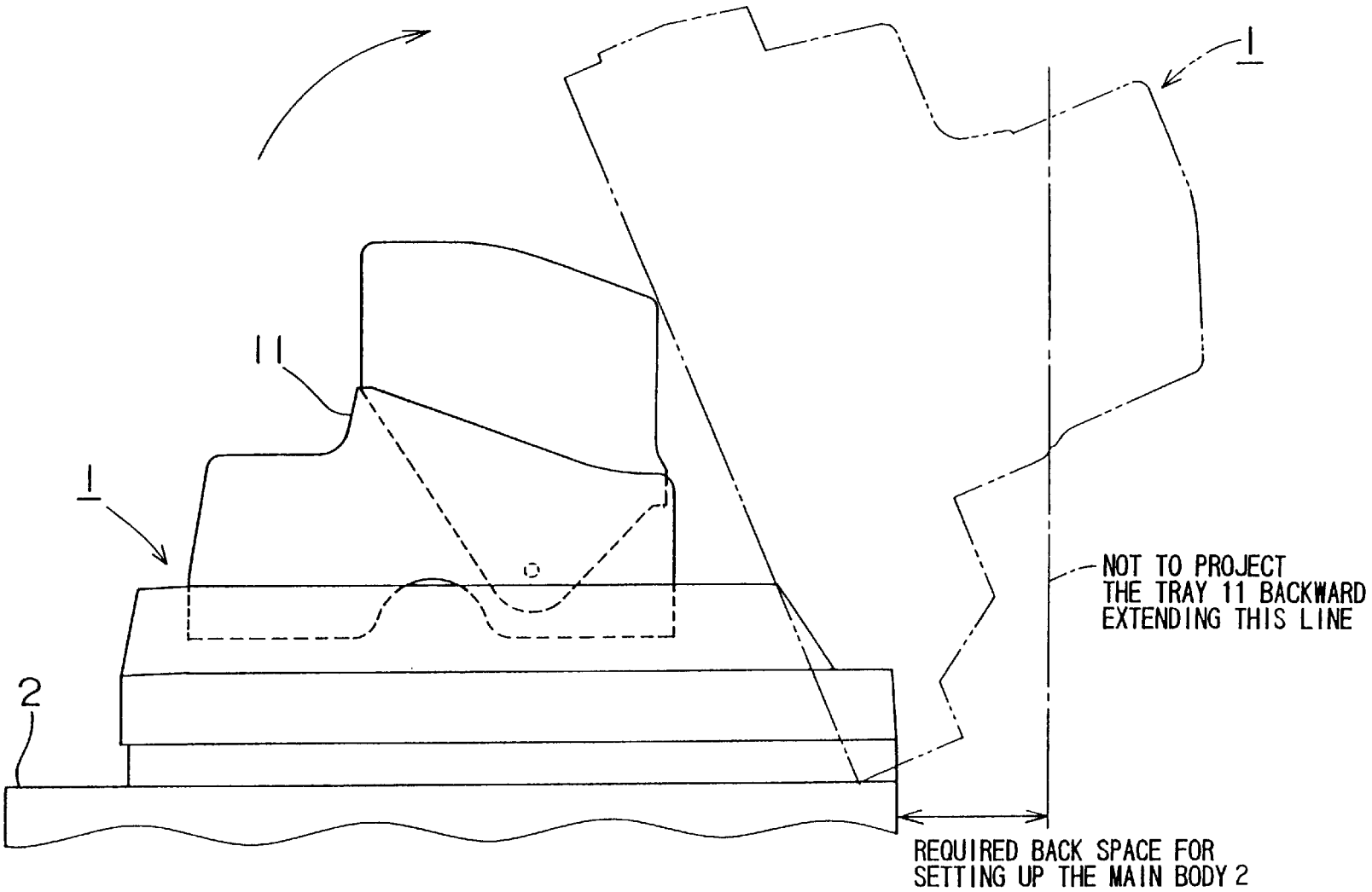
FIG. 3 is a right side view of the automatic document feeder shown in FIG. 1.

FIG. 1 is a perspective view showing the external construction of an automatic document feeder according to one embodiment of the present invention. FIG. 2 is a front view of the automatic document feeder shown in FIG. 1, which illustrates its construction in order to explain sections relating to the embodiment. FIG. 3 is a diagram showing the automatic document feeder shown in FIG. 1 as viewed from its right side surface.

The automatic document feeder 1 is mounted on the upper surface of the main body 2 of a copying machine. An original glass plate 15 (a glass on which originals to be copied are to be arranged) is provided on the upper surface of the main body 2 of the copying machine, and the automatic document feeder 1 also serves as its cover. The automatic document feeder 1 is so adapted that its front is opened upward centered with respect to its back in order that the originals can be arranged even manually on the original glass plate 15 (see a two-dot and dash line in FIG. 3).

An operation panel 6 comprising various groups of operation keys 4 including a copy start key 3 and a display 5 is arranged on the front side on the upper surface of the main body 2 of the copying machine. Operations and the like corresponding to the main body 2 of the copying machine and the automatic document feeder 1 are performed through the operation panel 6.

An original set surface 7 is formed in the center of the upper surface of the automatic document feeder 1. The original set surface 7 is a surface on which the originals to be copied are to be set. A pair of regulating guides for width direction of originals 8 is provided on the front and rear sides on the set surface 7. The regulating guides 8 are moved in synchronism nearer to or away from each other, and are so operated as to conform to the width of the originals set on the original set surface 7.

An original inlet port 9 is formed on the left side of the original set surface 7. An original discharge port 10 is formed on the right side of the original set surface 7. The originals set on the original set surface 7 are taken in one at a time from the original inlet port 9, are arranged on the above-mentioned original glass plate 15 so that images thereon are read, and are discharged from the original discharge port 10. A feed mechanism itself for conveying the originals does not characterize the present invention and is known and hence, the description thereof is omitted.

An original receiving tray 11 is provided in relation to the original discharge port 10. More specifically, the original receiving tray 11 is brought into a so-called cantilever holding state where its lower end is mounted in the vicinity of a right end of the original set surface 7, and the whole thereof extends obliquely up to the left toward a space above the original set surface 7. The originals discharged from the original discharge port 10 are guided toward the original receiving tray 11, and are discharged onto the original receiving tray 11.

The original discharge port 10 is so provided that the originals are discharged toward the original set surface 7, and the original receiving tray 11 is so arranged as to extend obliquely toward the space above the original set surface 7 as described above, whereby the original receiving tray 11 is not projected sideward from the automatic document feeder 1.

In a case where the original receiving tray 11 extends obliquely toward the space above the original set surface 7, however, when the originals are set on the original set surface 7, the original receiving tray 11 may, in some cases, interfere with the setting. Particularly, in cases such as a case where the originals set on the original set surface 7 are originals of the largest size which can be set, for example, originals of JIS A3 size, the originals are difficult to set.

In the present embodiment, the original receiving tray 11 is automatically driven by driving means to a down state where it obliquely falls as indicated by a solid line in FIG. 2 and an up state where it rises almost perpendicularly as indicated by a one-dot and dash line depending on the operating conditions of the automatic document feeder 1.

Furthermore, three sensors 12, 13 and 14, for example, are arranged below the original set surface 7. The sensor 12 is a set original sensor for sensing whether or not there are originals on the original set surface 7. The sensor 13 is an original size sensor for sensing the size of the originals set on the original set surface 7. If the set original sensor 12 senses the originals, and the original size sensor 13 does not sense the originals, it is judged that the size of the set originals is, for example, B5 size in Japanese Industrial Standard (hereinafter referred to as "JIS B5 size") or A4 size in Japanese Industrial Standard (hereinafter referred to as "JIS A4 size"). On the other hand, when both the sensors 12 and 13 sense the originals, it is judged that the size of the set originals is JIS B4 size or JIS A3 size in Japanese Industrial Standard (JIS) (hereinafter referred to respectively as "JIS B4 size" and "JIS A3 size"). In the present embodiment, the number of original size sensors 13 is set to only one. In the above-mentioned case, therefore, the JIS B4 size and the JIS A3 size, for example, cannot be distinguished. If the number of original size sensors is increased, therefore, the size of the originals can be judged more finely.

Furthermore, the sensor 14 is a discharged original sensor for sensing the presence or absence of originals on the original receiving tray 11.

The operations of the original receiving tray 11 will be described more specifically with reference to FIGS. 4A to 4D.

Figure 4A:
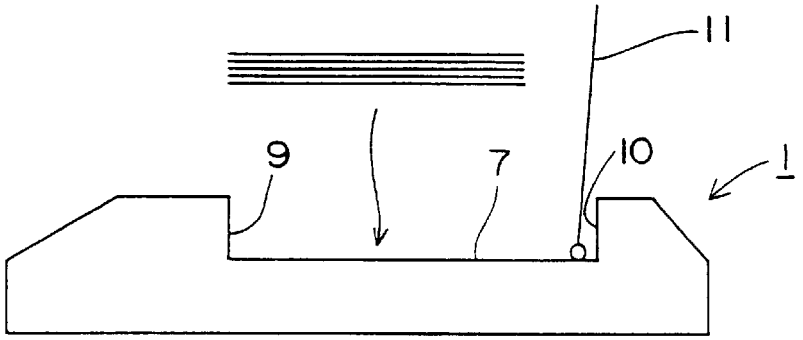
FIGS. 4A to 4D are illustrations for explaining operations of an original receiving tray.

In a state where no originals are set on the original set surface 7, that is, a state where the automatic document feeder 1 waits, the original receiving tray 11 is brought into an up state where it rises almost perpendicularly to the original set surface 7, as shown in FIG. 4A. Therefore, the tray 11 does not exist in the space above the original set surface 7, whereby the originals are easily set on the original set surface 7.

Figure 4B:
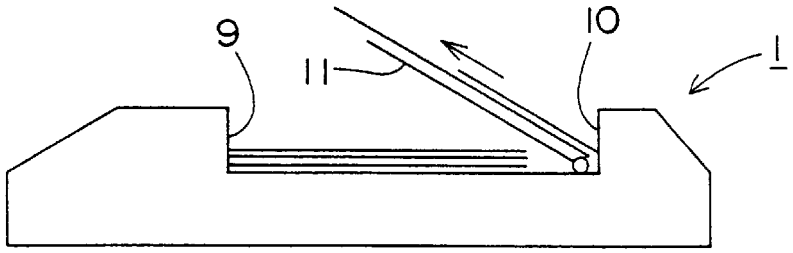

When the copy start key 3 (see FIG. 1) is then depressed after the originals are set on the original set surface 7, the original receiving tray 11 is brought into a down state where it obliquely falls, as shown in FIG. 4B. In this state, the original receiving tray 11 can smoothly introduce the originals discharged from the original discharge port 10, and can receive the discharged originals in line.

Figure 4C:
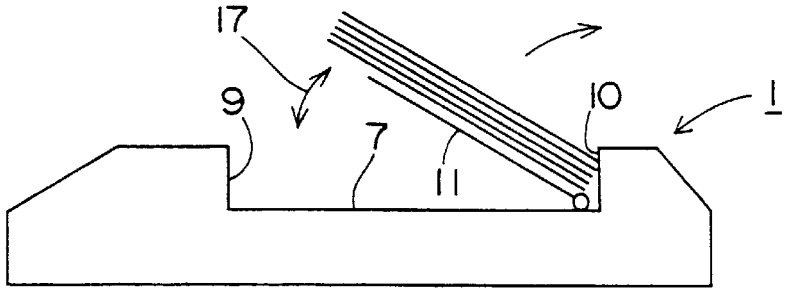

After all the originals have been copied, the original receiving tray 11 is swung up and down little by little, as indicated by an arrow 17, as shown in FIG. 4C. Consequently, it is possible to correct the disorder of the originals on the original receiving tray 11, and completely line up the lower ends of the originals.

Figure 4D:
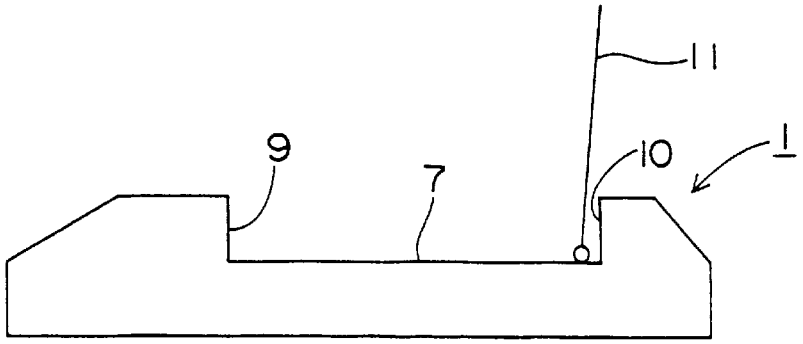

After the copying is terminated, the originals on the original receiving tray 11 are removed. Consequently, the original receiving tray 11 is brought into the up state where it rises perpendicularly to the original set surface 7 again, as shown in FIG. 4D. The automatic document feeder 1 waits for the subsequent copying.

As described in the foregoing, one feature in the present embodiment is that the original receiving tray 11 is driven to the up state and the down state automatically by the driving means depending on the operating conditions of the automatic document feeder 1. Consequently, the original receiving tray 11 does not interfere with the setting of the originals on the original set surface 7, and can satisfactorily guide and receive the originals discharged from the discharge port 10.

Figure 5:
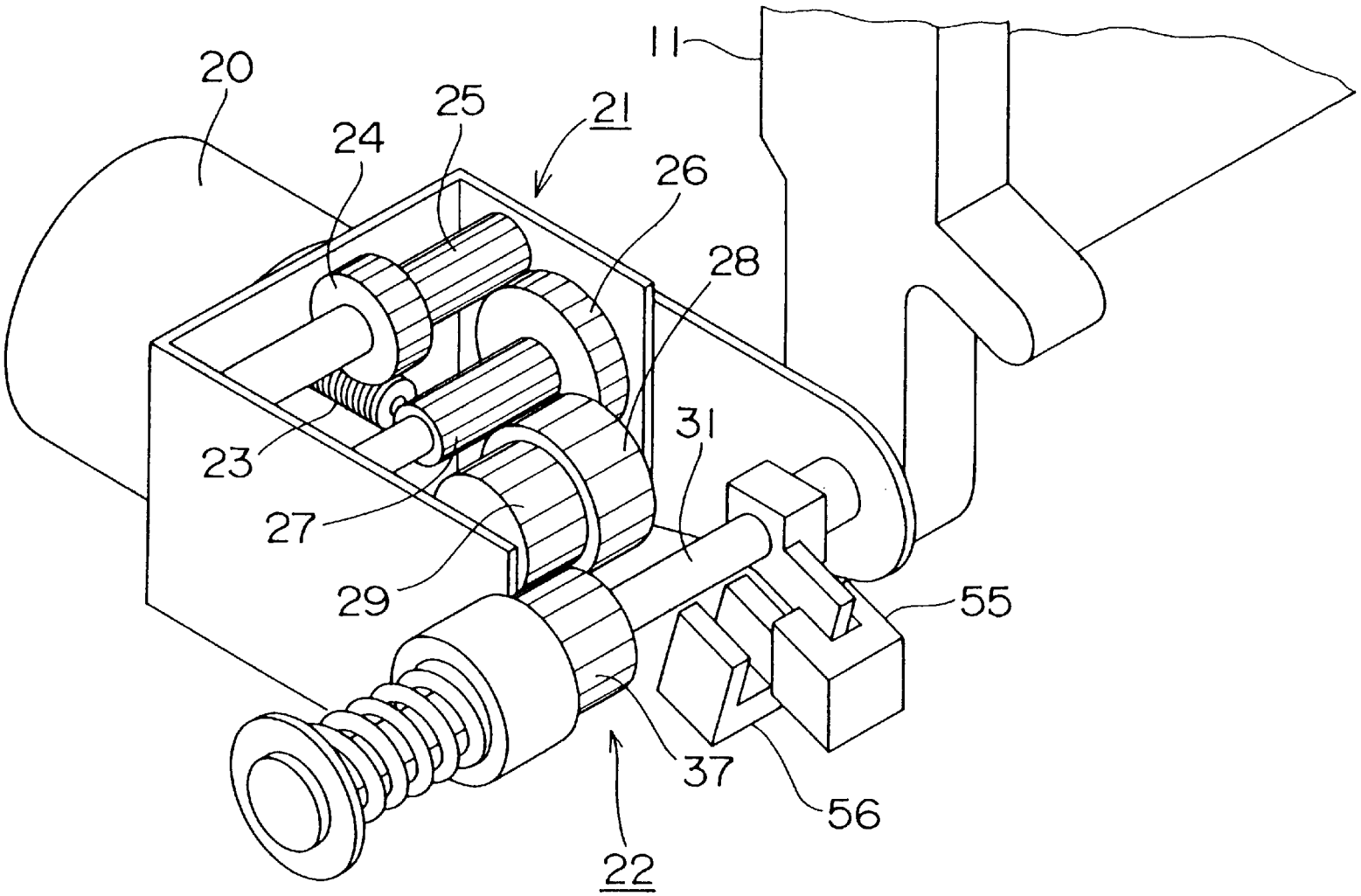
FIG. 5 is a perspective view of a driving mechanism for driving the original receiving tray to an up state and a down state.

FIG. 5 is a perspective view showing one example of the driving means for driving the original receiving tray 11 to the up state and the down state. The driving means for driving the original receiving tray 11 comprises a motor 20, a gear mechanism 21 for transmitting torque produced by the motor 20, and a slip driving mechanism 22 receiving a driving force from the gear mechanism 21, as shown in FIG. 5.

A DC motor, for example, capable of forward rotation and reverse rotation is used as the motor 20. A worm gear 23 is fitted in the axis of rotation of the motor 20. The rotation of the worm gear 23 is transmitted to a first large gear 24, and the rotation of the first large gear 24 rotates a first small gear 25 coaxially connected thereto. The first small gear 25 is engaged with a second large gear 26, and the rotation of the first small gear 25 is transmitted to the second large gear 26. A second small gear 27 is coaxially connected to the second large gear 26, and the rotation of the second large gear 26 is transmitted to the second small gear 27. Further, a third large gear 28 is engaged with the second small gear 27, and an output gear 29 is provided concentrically with the third large gear 28. Accordingly, the rotational speed of the motor 20 is decelerated by the gear mechanism 21 including the above-mentioned gears 23 to 29. The torque produced by the motor 20 is amplified by the gear mechanism 21, and is transmitted to the slip driving mechanism 22.

The slip driving mechanism 22 comprises an input gear 37 receiving the driving force from the gear mechanism 21, a slip mechanism as described later, and a driving shaft 31, and the original receiving tray 11 is driven by the driving shaft 31. Further, a tray up sensor 55 and a tray down sensor 56 for sensing the state of the original receiving tray 11 are provided in relation to the driving shaft 31.

Figure 6:
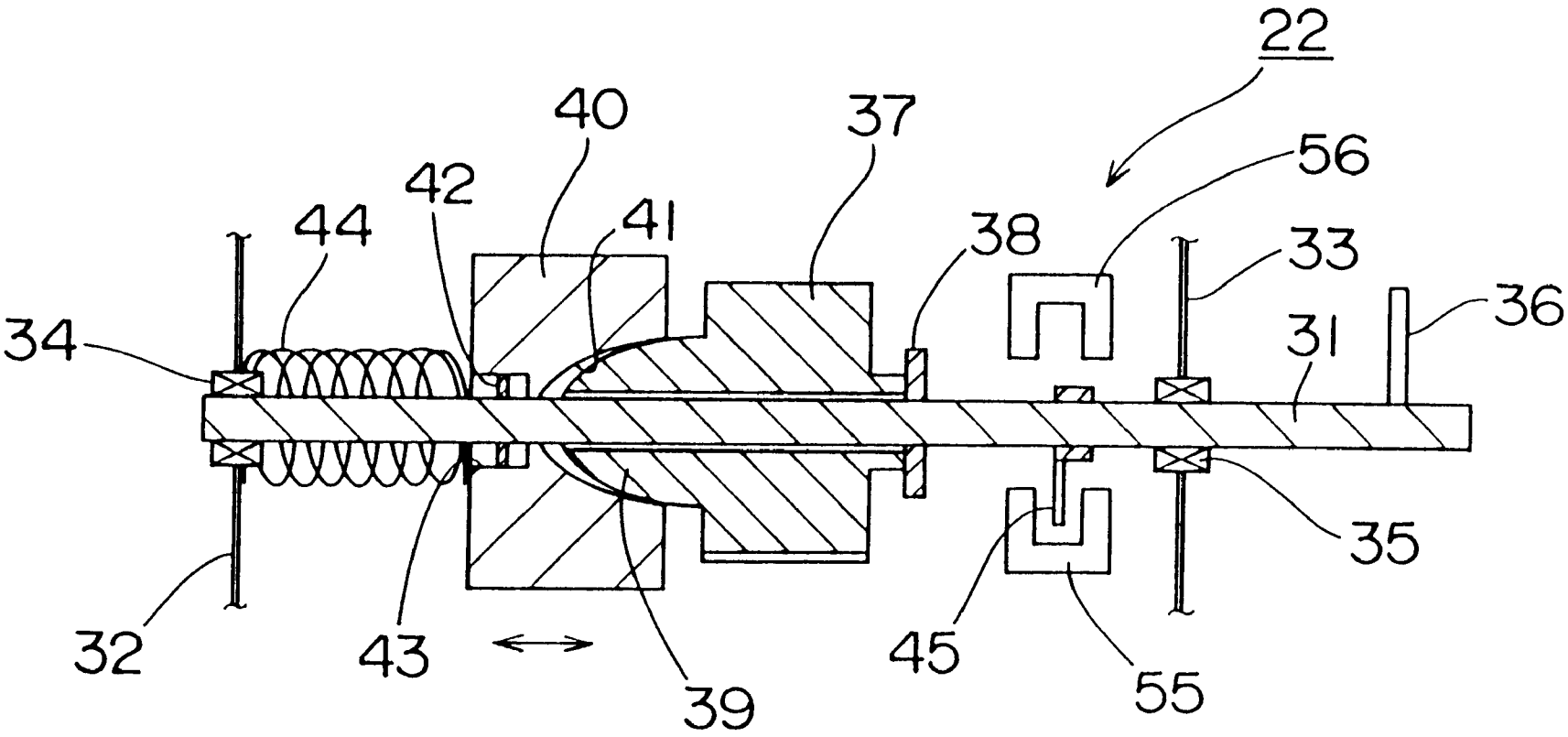
FIG. 6 is a diagram showing the construction of a slip driving mechanism.

FIG. 6 is a diagram showing the construction of the slip driving mechanism 22 provided in the present embodiment. The driving shaft 31 is provided in the slip driving mechanism 22. The driving shaft 31 is supported by a pair of supporting members 32 and 33. Specifically, one end (a left end) of the driving shaft 31 is rotatably supported by a bearing 34 mounted on the supporting member 32. On the other hand, a portion near the other end (a right end) of the driving shaft 31 penetrates through the supporting member 33, and a penetrating portion is rotatably supported by a bearing 35 fixed to the supporting member 33. The driving shaft 31 is so supported as not to be slidably displaceable in the direction of the length of the shaft with respect to the supporting members 32 and 33.

A tray mounting projection 36 for mounting the original receiving tray 11 is provided on the side of the right end of the driving shaft 31. When the driving shaft 31 is rotated, therefore, the original receiving tray 11 (not shown) mounted on the tray mounting projection 36 is driven, as described above.

The input gear 37 is externally fitted in the driving shaft 31. The input gear 37 is engaged with the output gear 29 in the above-mentioned gear mechanism 21 (see FIG. 5). The input gear 37 is rotatably mounted on the driving shaft 31. Even if the input gear 37 is rotated by the output gear 29, therefore, torque produced by the input gear 37 is not directly transmitted to the driving shaft 31. A positioning projection 38 is provided opposite to the side of one end, that is, the right side in FIG. 6 of the input gear 37. The positioning projection 38 is a pin or washer fastened to the driving shaft 31. The input gear 37 has its right end received by the positioning projection 38, whereby the input gear 37 cannot be slidably moved rightward along the driving shaft 31.

A rounded conical projection 39 formed integrally with the input gear 37 and projected toward the axis of the input gear 37 is provided on the side of the other end, that is, the left side of the input gear 37.

On the other hand, a driving force receiving member 40 which is engaged with the conical projection 39 is mounted on the driving shaft 31. The driving force receiving member 40 comprises a receiving recess 41 which can receive the conical projection 39 on the opposite side of the conical projection 39. The driving force receiving member 40 is so mounted as to be rotated integrally with the driving shaft 31, and is slidable in the direction of the length of the driving shaft 31. Specifically, a pin 42 is projected from the driving shaft 31, and a notch 43 which is engaged with the pin 42 is formed in the driving force receiving member 40. The notch 43 is made long toward the length of the driving shaft 31, and is so made wide that the pin 42 is fitted therein along the peripheral surface of the driving shaft 31.

Furthermore, a coil spring 44 which is externally fitted in the driving shaft 31 in a free state is fitted between a left end surface of the driving force receiving member 40 and the supporting member 32. The coil spring 44 always presses the driving force receiving member 40 rightward, and engages the receiving recess 41 and the conical projection 39 with each other by a predetermined frictional force.

The slip driving mechanism 22 is constructed as described above. When the input gear 37 is rotated, therefore, the torque produced by the input gear 37 is transmitted to the driving force receiving member 40 from the conical projection 39 through the receiving recess 41 in the normal state. If the driving force receiving member 40 is rotated, the driving shaft 31 is also rotated. Consequently, the original receiving tray 11 is driven.

On the other hand, when an attempt to manually drive the original receiving tray 11 is made, and the original receiving tray 11 is not moved upon colliding with something, a portion between the conical projection 39 and the receiving recess 41 slips, whereby the torque produced by the input gear 37 is not transmitted to the driving force receiving member 40. It can be determined by the materials of both the conical projection 39 and the receiving recess 41 and the tension of the coil spring 44 what degree of force should be applied to the original receiving tray 11 when the portion between the conical projection 39 and the receiving recess 41 slips.

When the original receiving tray 11 is driven by the motor 20, there are the following merits by interposing the above-mentioned slip driving mechanism 22 in a driving force transmitting path.

When a user first nipped his or her fingers, for example, in the original receiving tray 11 to be driven, the original receiving tray 11 is not forcedly driven, whereby torque to drive the original receiving tray 11 is idled by the slip driving mechanism 22. Even if the user nips his or her fingers, for example, in the original receiving tray 11, therefore, the user is not injured, for example.

When the user does not understand that the original receiving tray 11 is automatically driven, the user may, in some cases, manually bring the original receiving tray 11 into the down state or the up state. In such a case, the driving shaft 31 is rotated by moving the original receiving tray 11. However, torque produced by the driving shaft 31 is idled by the slip driving mechanism 22, not to be transmitted to the gear mechanism 21 and the motor 20 from the input gear 37. Therefore, the gear mechanism 21 and the like may not be damaged.

Furthermore, even if the motor 20 and the gear mechanism 21 develop faults, the original receiving tray 11 can be manually driven. Even when the driving means for driving the original receiving tray 11 develops a fault, therefore, the automatic document feeder 1 itself can be used without being interfered with by the fault.

A shielding plate 45 is further fixed to the driving shaft 31. A tray up sensor 55 and a tray down sensor 56 are arranged in the vicinity of the shielding plate 45. When the driving shaft 31 is rotated, the shielding plate 45 is moved, to be changeable to a state where it crosses the tray up sensor 55 and the tray down sensor 56 and a state where it does not cross the tray up sensor 55 and the tray down sensor 56. The tray up sensor 55 and the tray down sensor 56 output signals indicating whether the original receiving tray 11 is in the up state or the down state on the basis of the position of the shielding plate 45.

Figure 7:
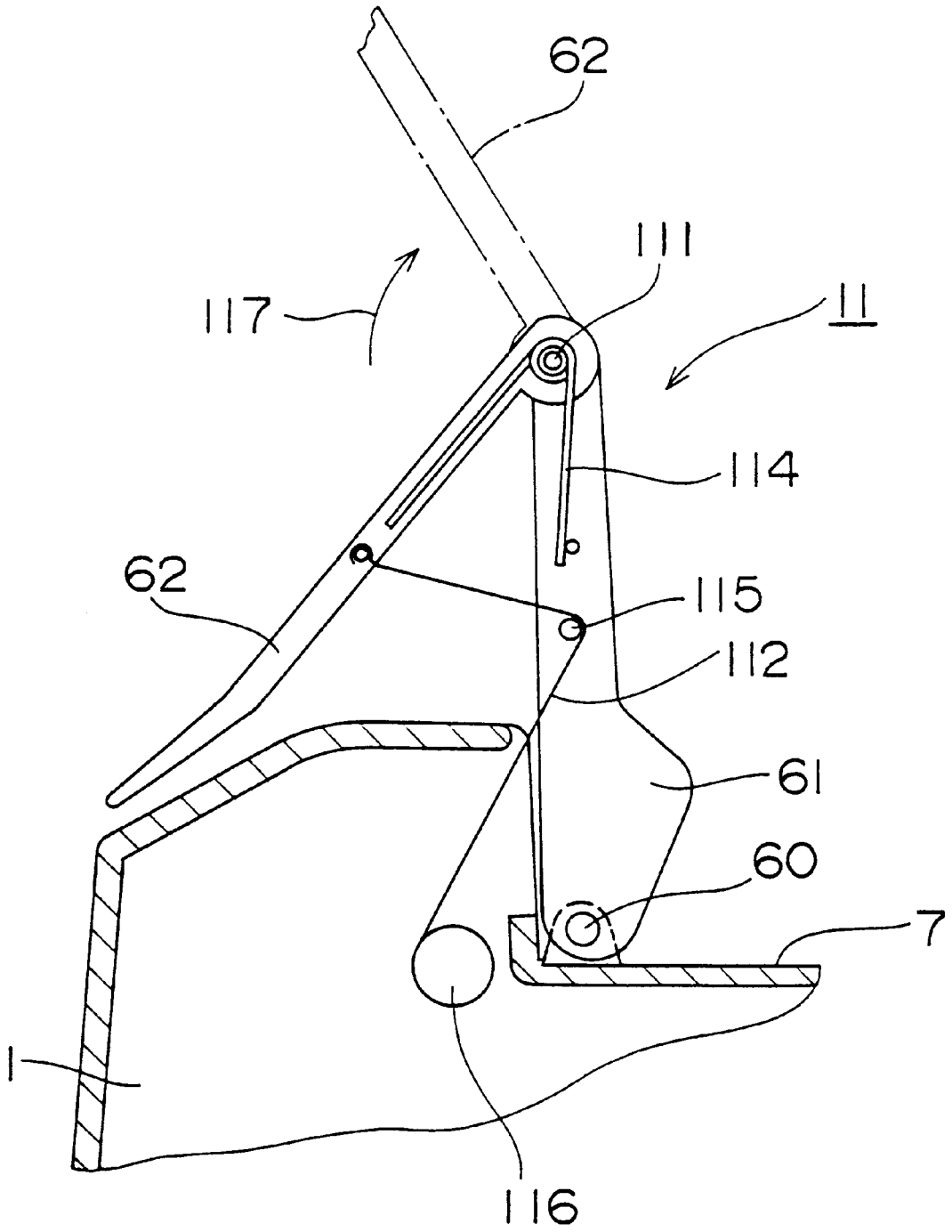
FIG. 7 is a partially sectional view of a principal part for explaining the shape and the construction of one example of the original receiving tray, which illustrates a state where the original receiving tray is viewed from the rear of the automatic document feeder.

FIG. 7 is a cross-sectional view showing a principal part for explaining the shape and the construction of the original receiving tray 11. FIG. 7 illustrates a state where the original receiving tray 11 is viewed from the rear of the automatic document feeder 1. Referring to FIG. 7, the original receiving tray 11 comprises a main tray 61 and a sub tray 62 connected to the main tray 61. The main tray 61 has its lower end connected to the mounting projection 36 of the above-mentioned driving shaft 31 (see FIG. 6). Further, the other lower end of the main tray 61 is rotatably held by, for example, a pin 60 provided on an original set surface 7.

A lower side of the sub tray 62 is rotatably connected to an upper side of the main tray 61 by a hinge pin 111. The axis of the hinge pin 111 is arranged parallel to a tray surface of the original receiving tray 11 and extending in the longitudinal direction. By rotating the sub tray 62, the connected state can be changed to an extending state where the sub tray 62 extends from the main tray 61 or a folded state where the sub tray 62 is folded with respect to the main tray 61 to decrease the external shape of the original receiving tray 11. FIG. 7 illustrates the folded state. A connecting structure between the sub tray 62 and the main tray 61 is so devised that the sub tray 62 is not folded rightward from the extending state indicated by a one-dot and dash line in FIG. 7.

A driving mechanism for making the above-mentioned connected state different, the original receiving tray 11 comprises a wire 112 stretched between the sub tray 62 and the main tray 61, a winding motor 113 for winding the wire 112 up (see FIG. 10), and an elastic member mounted in relation to the hinge pin 111, for example, a helical coil spring 114.

The helical coil spring 114 urges the main tray 61 and the sub tray 62 to approximately straight states by its elastic force. On the other hand, the wire 112 is so mounted that such a tensile force as to be opposed against the elastic force of the helical coil spring 114 is produced by driving the winding motor 113. That is, one end of the wire 112 is mounted on the sub tray 62, an intermediate portion of the wire 112 is guided by a pin 115 fixed to the main tray 61 to change the direction in which the wire 112 extends, and the other end of the wire 112 is fixed to the peripheral surface of a drum 116. The drum 116 is connected to an output shaft of the winding motor 113 through a torque limiter (not shown) so that no excessively large torque is applied to the wire 112. A DC motor, for example, capable of forward rotation and reverse rotation is used as the winding motor 113.

When the winding motor 113 is driven to be rotated in one direction, for example, in the forward direction, the wire 112 is wound up around the drum 116. At this time, a tensile force is exerted on the wire 112. The tensile force so functions as to reduce the distance between the main tray 61 and the sub tray 61 through the pin 115 in the main tray 61, to rotate the sub tray 62 against the elastic force of the helical coil spring 114. As a result, the connected state can be changed from the extending state to the folded state.

On the other hand, when the winding motor 113 is driven in the opposite direction, the wire 112 is drawn out, whereby the above-mentioned tensile force is not exerted on the wire 112. At this time, the connected state can be changed from the folded state to the extending state by the elastic force of the helical coil spring 114 (an arrow 117).

When the original receiving tray 11 is thus made changeable to the extending state and the folded state, there are the following merits.

By bringing the sub tray 62 into the extending state, the original receiving tray 11 can stably receive large paper sheets. On the other hand, by bringing the sub tray 62 into the folded state, the original receiving tray 11 can be decreased in external shape while corresponding to the large paper sheets. As a result, the amount of projection of the original receiving tray 11 toward the periphery is small, whereby the original receiving tray 11 does not interfere with the periphery.

This is effective in the following case. That is, as described with reference to FIG. 3, the automatic document feeder 1 also serves as the cover of the original glass plate 15. In cases where the originals are manually set on the original glass plate 15, and the surface of the original glass plate 15 is cleaned, therefore, the automatic document feeder 1 must be opened, as indicated by the two-dot and dash line in FIG. 3. At this time, the original receiving tray 11 provided in the automatic document feeder 1 is in the up state. Since the sub tray 62 is automatically changed from the extending state to the folded state as described later with respect to the main tray 61, however, the original receiving tray 11 is not projected toward the space behind the main body 2 of the copying machine. Even when there is a wall or the like in the space behind the main body 2 of the copying machine, therefore, the original receiving tray 11 can be used without colliding with the wall. Consequently, the original receiving tray 11 and the wall can be prevented from being damaged.

Since the original receiving tray 11 is not projected toward the space behind the main body 2 of the copying machine, the original receiving tray 11 can be set even in a place behind which there is a wall, close to the wall, whereby it is possible to improve the convenience for use of the copying machine.

Since the original receiving tray 11 is automatically changed to the folded state and the extending state upon being driven by the winding motor 113, the change takes no time and labor, whereby the original receiving tray 11 is convenient. For example, in the closed state, the original receiving tray 11 is brought into the extending state in preparation for automatic conveyance of originals, whereby the original receiving tray 11 can perform work without waiting, which is convenient for use.

In the present embodiment, in addition to causing the original receiving tray 11 to have the above-mentioned foldable structure, the original receiving tray 11 is automatically moved from the up state to the down state when the automatic document feeder 1 is opened, as described later. Even if the original receiving tray 11 is not folded due to faults or the like, therefore, the original receiving tray 11 does not collide with the wall or the like behind the main body 2 of the copying machine.

In the original receiving tray 11 shown in FIG. 7, even when the winding motor 113 is not driven, the original receiving tray 11 can be changed from the extending state to the folded state while allowing slack in the wire 112 if it is opposed against the elastic force of the helical coil spring 114. Even if the original receiving tray 11 is projected toward the space behind the main body 2 of the copying machine in a state where it is not completely brought into the folded state in cases such as a case where the automatic document feeder 1 is rapidly raised, and even if an upper end of the original receiving tray 11 collides with the wall or the like behind the main body 2 of the copying machine, the sub tray 62 can be folded, whereby the original receiving tray 11 is not interfered with.

As described in the foregoing, the main tray 61 and the sub tray 62 in the original receiving tray 11 have such a connecting structure that the original receiving tray 11 enters the folded state upon folding of tray surfaces of both the trays 61 and 62. In addition thereto, the main tray 61 and the sub tray 62 can also have such a connecting structure that the tray surfaces of the trays 61 and 62 are overlapped or are not overlapped with each other by the rotation of the sub tray 62 and the slidable movement thereof, as in modified examples described below.

In the following modified examples, the same components as those in the foregoing are assigned the same reference numerals. The direction of rotation of the winding motor 113 will be described as taking the direction in which the connected state between the main tray 61 and the sub tray 62 is changed from the extending state to the folded state as described above as "forward rotation".

Figure 8:
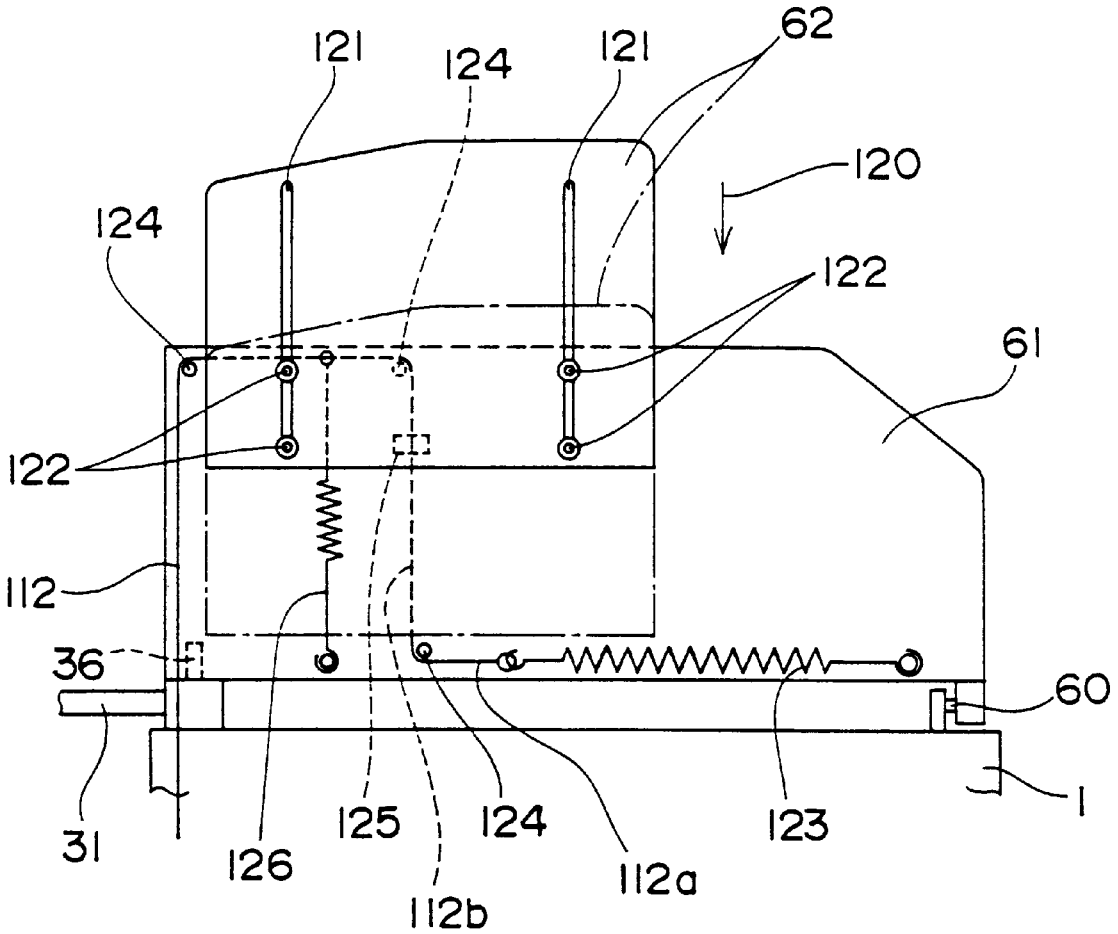
FIG. 8 is a diagram for explaining the shape and the construction of another example of the original receiving tray.

FIG. 8 is a diagram for explaining the shape and the construction of another example of the original receiving tray 11. The original receiving tray 11 differs from that shown in FIG. 7 in a connecting structure of a sub tray 62 to a main tray 61 and a driving mechanism for changing the sub tray 62 to an extending state and a folded state as the sub tray 62 is connected to the main tray 61.

Referring to FIG. 8, the sub tray 62 is slidably connected to the main tray 61 in a direction along the direction in which paper sheets are moved (indicated by an arrow 120) while making their tray surfaces parallel to each other by guide grooves 121 and guide pins 122. Specifically, the two guide grooves 121 are formed in the sub tray 62 so as to extend parallel to each other and along the direction in which the paper sheets are moved. The guide pins 122 are projected from the main tray 61, and the two guide pins 122 are engaged with the guide groove 121. Therefore, the sub tray 62 can be moved along the direction in which the guide grooves 121 extend in the range in which the guide grooves 121 extend. By slidably moving the sub tray 62, the connected state can be made changeable to an extending state shown in FIG. 8 or a folded state where the tray surfaces are overlapped with each other with respect to the main tray 61 (indicated by a one-dot and dash line).

Although in this example, the guide pins 122 and the guide grooves 121 are respectively provided in the main tray 61 and the sub tray 62, the guide grooves and the guide pins may be respectively provided in the main tray 61 and the sub tray 62.

A driving mechanism for making the above-mentioned connected state different, the original receiving tray 11 comprises a wire 112, a winding motor 113, and an elastic member for pulling the wire 112, for example, a helical coil spring 123.

One end of the helical coil spring 123 is fixed to the main tray 61, and the other end thereof is mounted to a free end 112*a* of the wire 112 in a pulled state. The wire 112 is laid on the main tray 61 while changing the direction in which it extends by a pulley 124 mounted on the main tray 61. An intermediate portion 112*b* of the wire 112 extends along the direction in which the sub tray 62 slides, and a part thereof and an approximately central portion of a lower end of the sub tray 62 are fixed to each other by a fixture 125. The other end of the wire 112 is connected to the winding motor 113 in the same manner as that in the example shown in FIG. 7. A tension spring 126 for removing slack is mounted on the wire 112.

When the winding motor 113 is driven to be rotated in the reverse direction, the wire 112 is wound up against an elastic force of the helical coil spring 123. At this time, the intermediate portion 112*b* of the wire 112 is moved upward (in a direction opposite to the direction indicated by the arrow 120) in FIG. 8, and the sub tray 62 is also slidably moved in the same direction. As a result, the connected state can be changed from the folded state to the extending state.

On the other hand, when the winding motor 113 is driven to be rotated in the forward direction, the wire 112 is drawn out, and is pulled by the elastic force of the helical coil spring 123, whereby the sub tray 62 is slidably moved in the direction indicated by the arrow 120. Consequently, the connected state can be changed from the extending state to the folded state.

Figure 9:
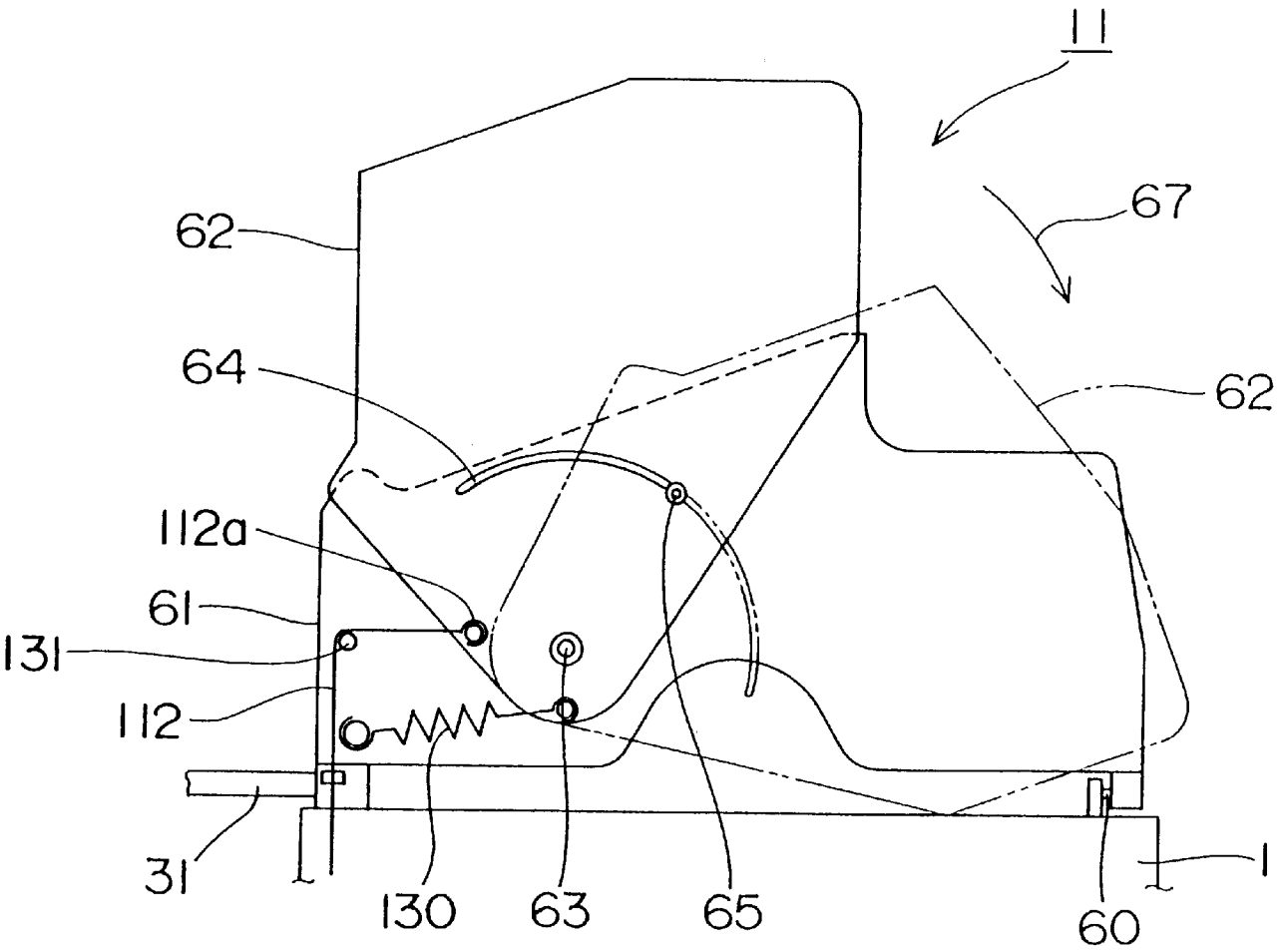
FIG. 9 is a diagram for explaining the shape and the construction of still another example of the original receiving tray.

FIG. 9 is a diagram for explaining the shape and the construction of still another example of the original receiving tray 11. Referring to FIG. 9, a sub tray 62 is connected to a main tray 61 by a supporting shaft 63. The sub tray 62 is rotatable around the supporting shaft 63 with respect to the main tray 61. A guide groove 64 and a guide pin 65 are further provided between the main tray 61 and the sub tray 62. The guide groove 64 is formed in the sub tray 62, and is in the shape of a circular arc centered around the supporting shaft 63. The guide pin 65 is projected from the main tray 61, and is engaged with the guide groove 64 in the sub tray 62. Therefore, the sub tray 62 can be swung in the range of the guide groove 64 around the supporting shaft 63. By swinging the sub tray 62, the connected state can be changed to an extending state shown in FIG. 9 or a folded state (indicated by a two-dot and dash line).

Although in this example, the guide pin 65 and the guide groove 64 are respectively provided in the main tray 61 and the sub tray 62, the guide groove and the guide pin may be respectively provided in the main tray 61 and the sub tray 62.

As a driving mechanism for making the above-mentioned connected state different, the original receiving tray 11 comprises a wire 112, a winding motor 113 (see FIG. 10), and an elastic member mounted in a pulled state between the main tray 61 and the sub tray 62, for example, a spring 130.

A free end 112*a* of the wire 112 is mounted on the main tray 61 so that a tensile force is exerted on the wire 112 by an urging force of the spring 130. The direction in which the wire 112 extends is changed by a pulley 131, whereby the other end of the wire 112 is connected to the winding motor 113 in the same manner as that in the above-mentioned examples.

When the winding motor 113 is driven to be rotated in the reverse direction, the wire 112 is wound up against an elastic force of the spring 130, whereby the sub tray 62 is rotated in a direction opposite to a direction indicated by an arrow 67. As a result, the original receiving tray 11 can be changed from the folded state to the extending state.

On the other hand, when the winding motor 113 is driven to be rotated in the forward direction, the wire 112 is drawn out, and is pulled by the elastic force of the spring 130, whereby the sub tray 62 is also rotated in the direction indicated by the arrow 67. Consequently, the original receiving tray 11 is brought into the folded state.

In the original receiving tray 11 shown in FIG. 9, when it is thus changed from the extending state to the folded state, the wire 112 is moved by the elastic force of the spring 130 and the driving of the winding motor 113. Consequently, the wire 112 can be smoothly moved, as compared with that in a case where it is moved in the opposite direction. This is preferable for rapidly bringing the original receiving tray 11 into the folded state.

Figure 10:
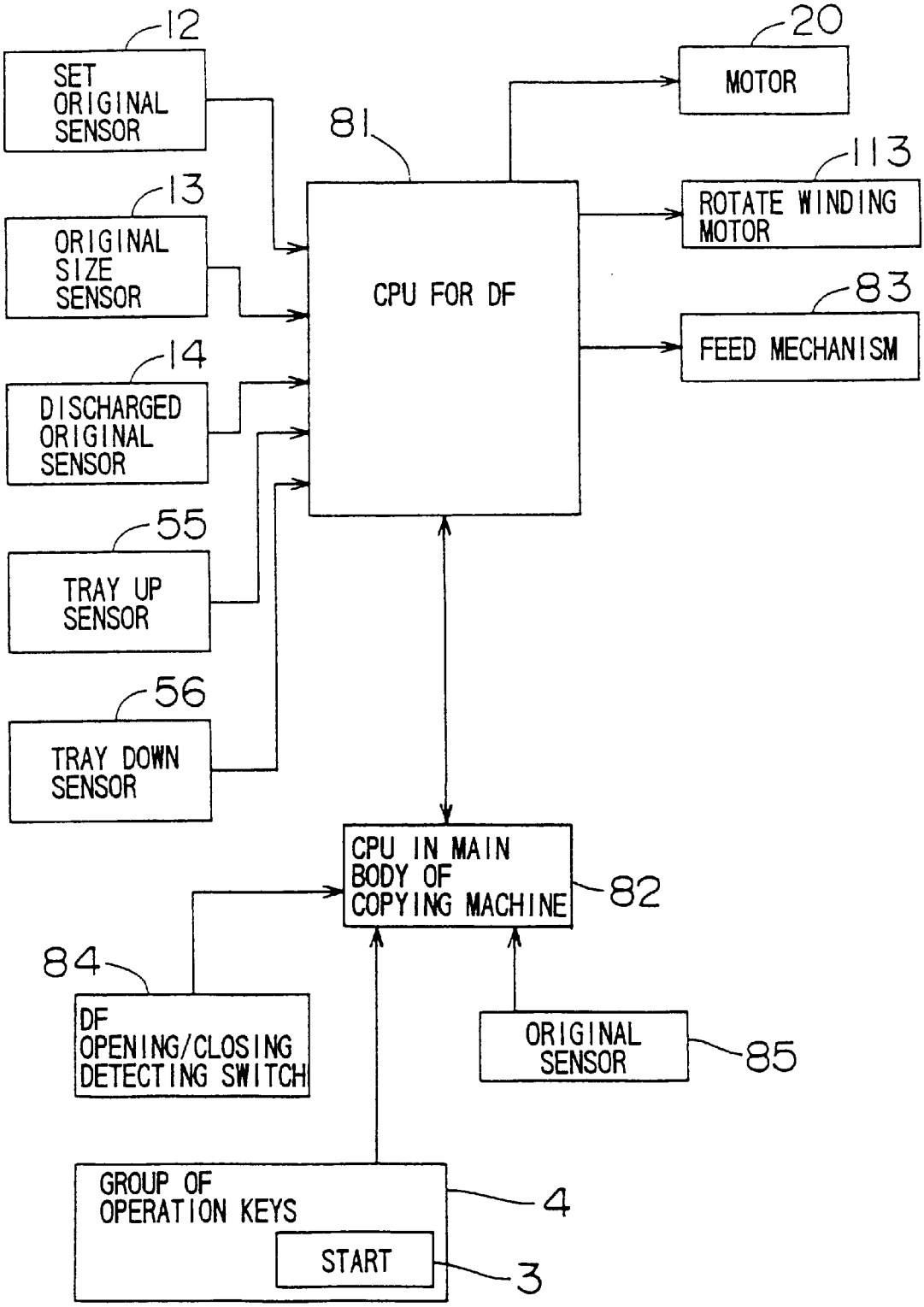
FIG. 10 is a block diagram showing a control circuit in the automatic document feeder shown in FIG. 1.

FIG. 10 is a block diagram showing a control circuit in the automatic document feeder 1 according to the present embodiment, which also illustrates the relationship with a control section in the main body 2 of the copying machine.

Referring to FIG. 10, the automatic document feeder 1 comprises a CPU for DF 81 serving as the center of driving control. Outputs from the set original sensor 12, the original size sensor 13, the discharged original sensor 14, the tray up sensor 55 and the tray down sensor 56 are fed to the CPU for DF 81. In the CPU for DF 81, the driving of the rotate winding motor 113, the motor 20, and the original feed mechanism 83 is controlled on the basis of the signals from the respective sensors, a control instruction from a CPU 82 in the main body of the copying machine, and the like.

The above-mentioned CPU 82 in the main body of the copying machine is connected to the CPU for DF 81. A signal from a DF opening/closing detecting switch 84 for detecting whether the automatic document feeder 1 is opened (in cases such as a case where it is opened in order to manually set the originals on the original glass plate 15) or closed, a signal from an original sensor 85 for sensing whether or not there are originals left on the original glass plate 15 in the main body 2 of the copying machine, and a signal from the group of operation keys 4 including the copy start key 3 are fed to the CPU 82 in the main body of the copying machine. The CPU 82 in the main body of the copying machine controls the driving of the main body 2 of the copying machine, and gives data, an instruction and the like required to drive the automatic document feeder 1 to the CPU for DF 81 on the basis of the signals. A control signal and the like of the CPU for DF 81 are fed to the CPU 82 in the main body of the copying machine, and are utilized for controlling the main body 2 of the copying machine.

Figure 11:
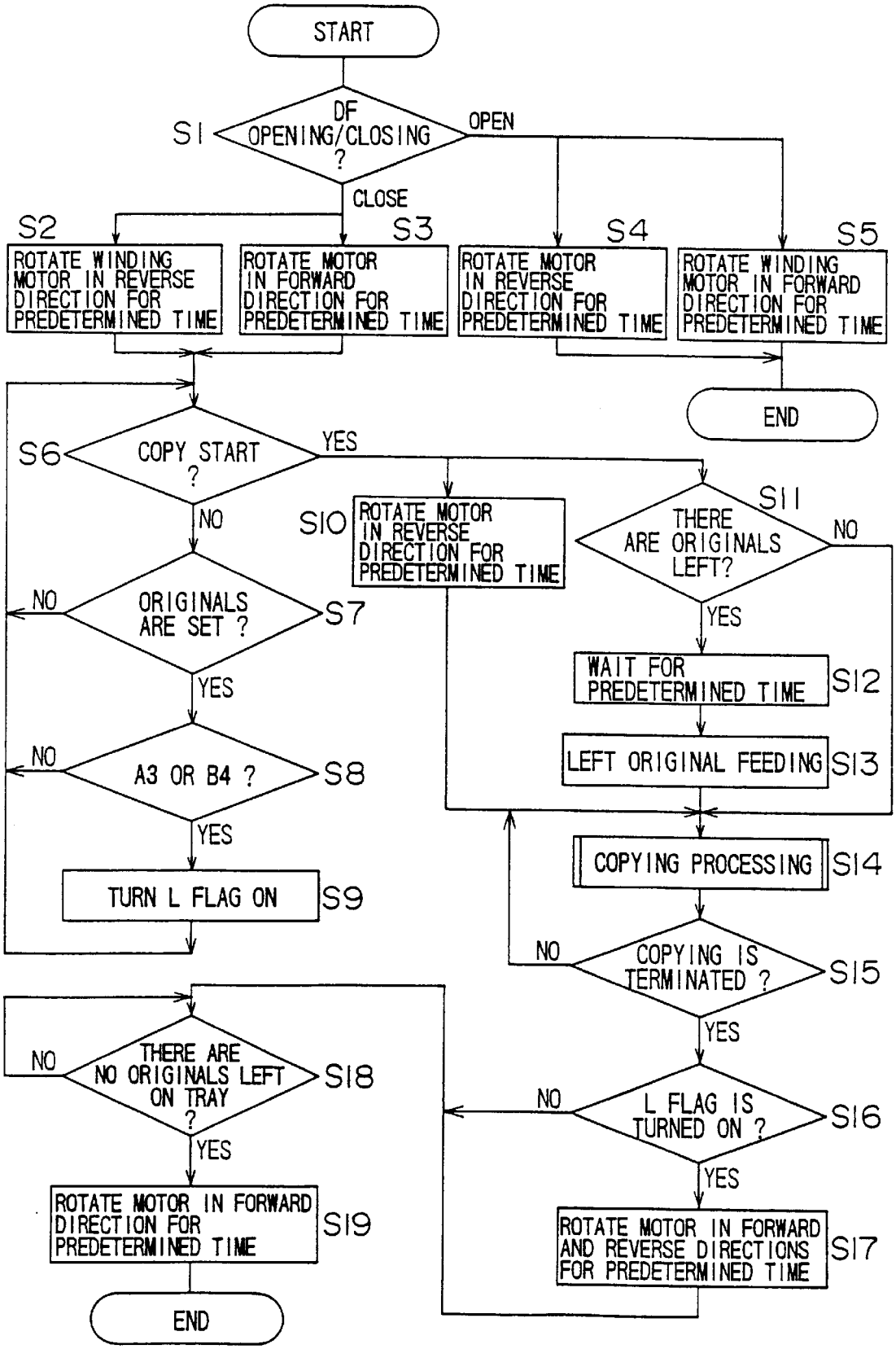
FIG. 11 is a flow chart showing control operations of the automatic document feeder shown in FIG. 1.
Figure 12:
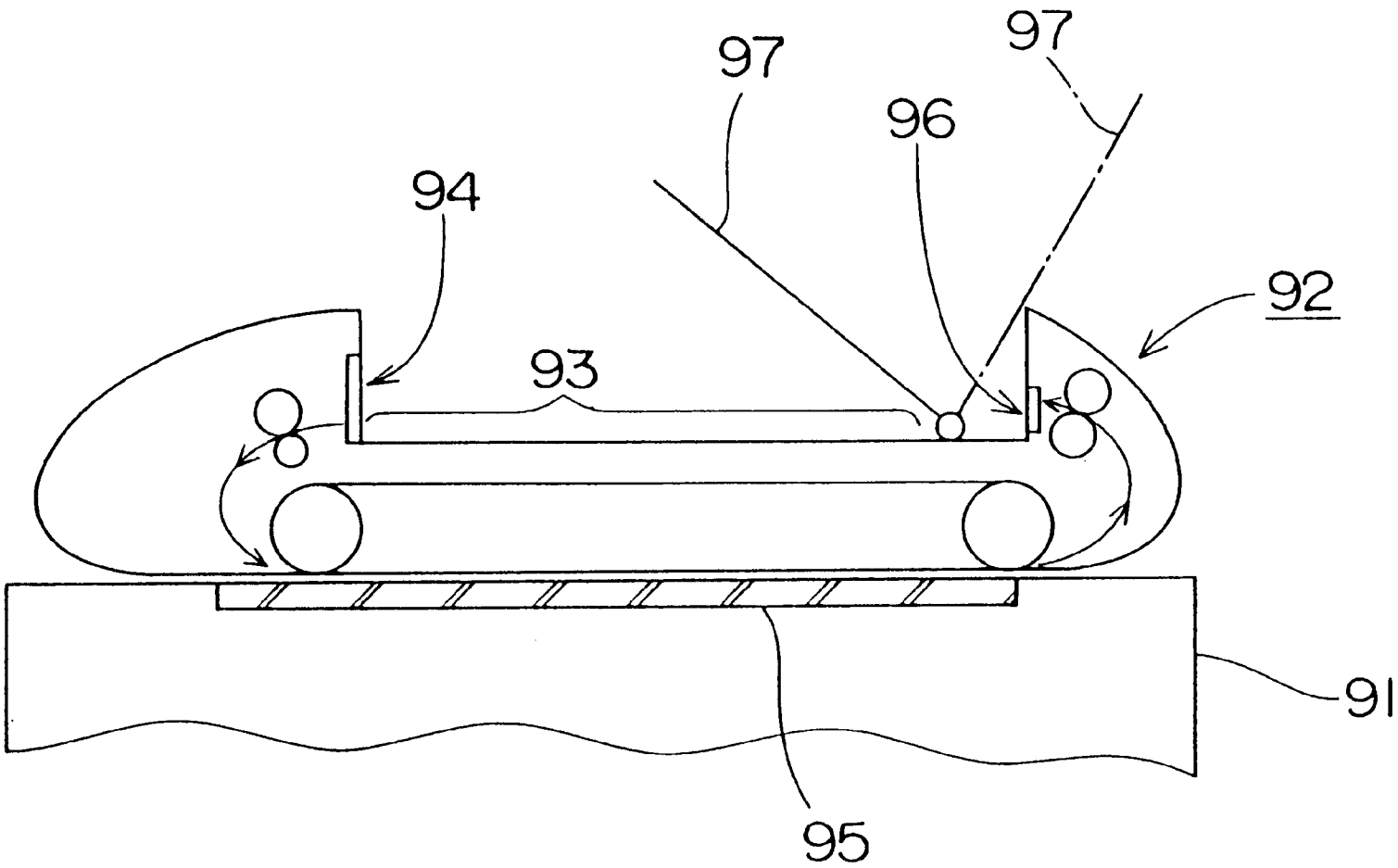
FIG. 12 PRIOR ART
FIG. 12 is a schematic view showing a conventional automatic document feeder for a copying machine as viewed from the front.

FIG. 11 is a flow chart showing control operations of the automatic document feeder 1.

The operations of the automatic document feeder 1 will be described in relation to the operations of the main body 2 of the copying machine in accordance with the flow of FIG. 11.

When control is started, it is first judged whether the automatic document feeder 1 is opened or closed (step S1). This judgment is made depending on whether the DF opening/closing detecting switch 84 is turned on or off. When it is judged that the automatic document feeder 1 is opened, the winding motor 113 is so driven as to be rotated in the forward direction for a predetermined time, to bring the original receiving tray 11 into the folded state (step S5). The motor 20 is rotated in the reverse direction for a predetermined time in parallel with the processing, whereby the original receiving tray is brought into the down state (step S4).

On the other hand, when it is judged in step S1 that the automatic document feeder 1 is closed, the winding motor 113 is driven to be rotated in the reverse direction for a predetermined time, to bring the original receiving tray 11 into the extending state (step S2). The motor 20 is rotated in the forward direction for a predetermined time in parallel with the processing, whereby the original receiving tray 11 is brought into the up state (step S3).

The automatic document feeder 1 then enters a waiting state where processing in the following steps S6 to S9 is performed until the copy start key 3 is depressed. It is first judged in step S6 whether or not the copy start key 3 provided in the main body 2 of the copying machine is depressed.

When it is judged in step S6 that the copy start key 3 is not depressed, it is further judged whether or not the originals are set on the original set surface 7 (step S7). This judgment is made by the presence or absence of an output of the set original sensor 12.

When it is judged that the originals are set on the original set surface 7, the size of the originals is further judged (step S8). This judgment is made depending on the presence or absence of an output from the original size sensor 13. In the present embodiment, when the size of the originals set on the original set surface 7 is JIS A3 size or JIS B4 size, an L flag indicating that the size of the originals is large is turned on (step S9). When the size of the originals set on the original set surface 7 is A4 size or B5 size, the L flag is not turned on.

The flag is realized by a work register or the like in the CPU for DF 81.

In the waiting state in step S6, when copies are made by manual operations, the originals are not set on the original set surface 7 even if the copy start key 3 is depressed. If it is judged in step S7 that no originals are set, copying processing is performed only by the main body 2 of the copying machine, whereby the automatic document feeder 1 is not operated and is maintained in a waiting state. Even in this waiting state, the foregoing steps S1 to S5 are suitably carried out as a detection output of the DF opening/closing detecting switch 84 is provided. In opening or closing the automatic document feeder 1 at the time of manual operations, therefore, the original receiving tray 11 can assume the above-mentioned states.

On the other hand, when the originals are conveyed using the automatic document feeder I and are copied, the copy start key 3 is depressed after the originals are set on the original set surface 7. If it is judged in step S7 that the originals have been already set, the processing proceeds to the step S10 when the copy start key 3 is depressed.

In the step S10, the motor 20 is rotated in the reverse direction for a predetermined time, whereby the original receiving tray 11 is brought into the down state. The reason why this processing is performed is that the original receiving tray 11 is brought into the up state in step S3, so that the original receiving tray 11 is generally in the up state at this time point.

Processing in steps S11 to S13 is performed in parallel with the processing in the step S10.

Specifically, it is judged in step S11 whether or not there are originals left on the original glass plate 15 in the main body 2 of the copying machine. This judgment is made by the presence or absence of an output of the original sensor 85 provided in the main body 2 of the copying machine.

When there are originals left, the automatic document feeder 1 waits for a predetermined time (step S12), after which left original feeding processing is performed (step S13). The left original feeding processing is to feed the left originals by the automatic document feeder 1 and discharge the originals to the original receiving tray 11 from the original discharge port 10.

As described in the foregoing, the processing in steps S11 to S13 is performed in parallel with the processing in step S10. In a case where there are originals left, therefore, when the left original feeding processing is immediately performed, there is a possibility that the left originals are discharged from the original discharge port 10 before the original receiving tray 11 is brought into the down state. In order to eliminate the possibility, the automatic document feeder 1 waits for a predetermined time in step S12.

When there are no originals left, the processing in steps S12 and S13 is omitted.

Copying processing is then performed in step S14. In the copying processing, the originals set on the original set surface 7 are taken in one at a time from the original inlet port 9 and are set on the original glass plate 15, and the main body 2 of the copying machine reads the contents of the originals and copies the originals. The copied originals whose contents are read are discharged to the original receiving tray 11 from the original discharge port 10.

All the originals set on the original set surface 7 will be copied. In the present embodiment, it is judge whether or not the copying processing is terminated on the basis of an output of the set original sensor 12 for sensing the originals on the original set surface 7 (step S15).

When the copying processing is terminated, it is judged whether or not the L flag is turned on (step S16). When the L flag is turned on, the originals discharged to the original receiving tray 11 are originals of relatively large size, whereby the motor 20 is repeatedly rotated in the forward and reverse directions for a predetermined time in order to line up the trailing ends of the originals of large size (step S17). Consequently, the original receiving tray 11 in the down state is swung up and down. Therefore, the originals discharged onto the original receiving tray 11 slip downward along the original receiving tray 11, so that the trailing ends of the discharged originals are completely lined up.

After the copying is terminated, the originals on the original receiving tray 11 are removed. It is judged on the basis of an output of the discharged original sensor 14 whether or not there are originals left on the original receiving tray 11. When it is judged in step S18 that there are no originals left on the original receiving tray 11, the original receiving tray 11 is in the down state if it is not manually moved. Therefore, the motor 20 is rotated in the forward direction for a predetermined time, whereby the original receiving tray 11 is brought into the up state (step 19).

Consequently, the automatic document feeder 1 is returned to the copying waiting state where the original receiving tray 11 is in the up state.

Although in the above-mentioned embodiment, the DF opening/closing detecting switch 84 can judge whether the automatic document feeder 1 is opened or closed, it may be one capable of detecting the closed state. In this case, when the closed state is detected in the step S1, the processing in the steps S2 and S3 is performed. When the closed state is not detected, it can be judged that the automatic document feeder 1 is being opened, whereby the processing in the steps S4 and S5 is performed. By thus detecting that the closed state is released, the motor 20 and the winding motor 113 can be driven before the automatic document feeder 1 is raised to enter the opened state. As a result, there is sufficient time to bring the original receiving tray 11 into the down state or the folded state before the original receiving tray 11 is projected backward, which can sufficiently cope with a rapid opening or closing operation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An automatic document feeder which is mounted on an image forming apparatus and is displaceable to a closed state and an open state with respect to the image forming apparatus, the automatic document feeder comprising:

an entire tray having a main tray and a sub tray for receiving paper sheets;

connecting means for connecting the main tray and the sub tray to each other; and means for automatically changing the external shape of the entire tray by changing a connected state of the connecting means in response to a change in the state of the automatic document feeder from the closed state to the open state.

2. The automatic document feeder according to claim 1, wherein the connecting means can change the connected state between an extending state where the sub tray extends from the main tray and a contracted state where the sub tray is folded or superimposed with respect to the main tray.

3. The automatic document feeder according to claim 2, wherein the changing means causes the connected state to be the extending state when the automatic document feeder is in the closed state, and causes the connected state to be the contracted state when the automatic document feeder is in the open state.

4. The automatic document feeder according to claim 3, further comprising a set surface on which paper sheets to be conveyed are to be set, and conveying means having an inlet port and a discharge port which are provided so as to be opposite to each other while being separated by the set surface on both sides of the set surface for taking in the paper sheets set on the set surface from the inlet port, conveying the paper sheets on a predetermined path, and discharging the paper sheets toward the set surface from the discharge port, one end of the main tray in said tray being mounted in the vicinity of the discharge port.

5. The automatic document feeder according to claim 4, wherein one end of the main tray is rotatably mounted in the vicinity of the discharge port.

* * * * *